United States Patent [19]

Schippers et al.

[11] Patent Number: 4,629,137

[45] Date of Patent: Dec. 16, 1986

[54] YARN SENSOR

[75] Inventors: Heinz Schippers; Erich Lenk; Hermann Bremer, all of Remscheid, Fed. Rep. of Germany

[73] Assignee: Barmag Barmer Maschinenfabrik Aktiengesellschaft, Remscheid, Fed. Rep. of Germany

[21] Appl. No.: 719,209

[22] Filed: Apr. 2, 1985

[30] Foreign Application Priority Data

Apr. 7, 1984 [DE] Fed. Rep. of Germany ..... 3413275
Jun. 15, 1984 [DE] Fed. Rep. of Germany ..... 3422308

[51] Int. Cl.[4] ..... B65H 59/38; B65H 59/04

[52] U.S. Cl. ..... 242/45; 226/45; 242/156

[58] Field of Search ..... 242/45, 156, 156.2, 242/75.4, 75.43, 75.5, 75.53; 226/45

[56] References Cited

U.S. PATENT DOCUMENTS

| | | | |
|---|---|---|---|
| 2,098,422 | 11/1937 | Keen et al. | 242/156.2 |
| 2,343,181 | 2/1944 | Heinz | 242/75.53 X |
| 2,667,311 | 1/1954 | Packer et al. | 242/75.43 |
| 2,938,365 | 5/1960 | Lassiter | 242/45 X |
| 2,964,440 | 12/1960 | Stevens | 242/75.43 X |
| 3,533,574 | 10/1970 | Cooper | 242/150 |
| 4,234,133 | 11/1980 | Enneking | 242/45 |
| 4,280,322 | 7/1981 | Inger | 57/81 |

FOREIGN PATENT DOCUMENTS

| | | |
|---|---|---|
| 465462 | 12/1968 | Fed. Rep. of Germany . |
| 2832930 | 2/1980 | Fed. Rep. of Germany . |
| 1444141 | 12/1966 | France . |
| 2232503 | 1/1975 | France . |

*Primary Examiner*—Stanley N. Gilreath
*Attorney, Agent, or Firm*—Bell, Seltzer, Park & Gibson

[57] ABSTRACT

A pneumatic sensor is provided for detecting and indicating the tension in running strand material, such as yarn, wire and the like. A source of compressed air is connected to an air escape nozzle having an outlet opening in one end thereof and a closing member is supported adjacent the outlet opening and is normally spaced a predetermined distance from the outlet opening to regulate and partially restrict the escape of air therefrom. The strand engages the closing member and varies the space or gap between the closing member and the nozzle outlet in accordance with the amount of tension in the strand. A pressure gauge is provided for indicating the amount of air pressure in the pneumatic pressure system and for thereby indicating the amount of tension in the running strand. A pressure/electric transducer is operable by the pneumatic pressure system and may operate a control system for a variable speed motor in a yarn take-up system to vary the takeup rate to maintain a predetermined tension on the yarn being taken up. The variation in air pressure in the pneumatic pressure system may also be utilized to operate a pneumatic cylinder for varying the braking force applied to a wire let-off beam in an unwinding operation so that the tension in the wire is maintained within a predetermined tension range.

9 Claims, 5 Drawing Figures

YARN SENSOR

This invention relates generally to a yarn sensor, and more particularly to a pneumatic sensor for detecting, indicating and/or controlling the tension in running strand material such as yarn, wire and the like.

It is generally known to provide a yarn sensor for running strand material. For example, German Pat. No. 28 32 930 discloses a yarn detector which only senses the presence or absence of a running yarn and emits a positive signal if the yarn is present and a negative signal when the running yarn is broken.

In contrast to this prior type of yarn sensor, the yarn sensor of the present invention continuously measures the tension in the running strand material and provides a continuous output signal indicating the amount of tension in the strand material. This output signal may be used to control either the take-up or let-off speeds of the strand and to thereby maintain the tension of the running strand within predetermined limits.

The pneumatic sensor of the present invention includes a source of compressed air for continuously supplying air under a preadjusted and predetermined pressure and through a pneumatic pressure system to the inlet end of an air escape nozzle having an outlet opening in the other end thereof. A closing member is supported adjacent the outlet opening and is normally spaced a predetermined distance from the outlet opening to partially restrict escape of air therefrom. A strand guide is associated with the closing member and diverts the normal path of travel of the strand so that variations in the tension in the running strand causes variations in the distance between the closing member and the outlet opening in the nozzle. Variations in the distance between the closing member and the outlet opening cause the air pressure in the pneumatic pressure system to vary in accordance with variations in the tension in the running strand. The air pressure in the pneumatic pressure system is measured by any conventional type of air pressure measuring device and indicated on a suitable pressure or tension indicating device. Alternatively, a pressure/electric transducer, such as a piezoelectric transducer, can be operatively connected to a control system for regulating the tension of the yarn within predetermined limits by regulating the take-up or let-off speeds of the running strand.

The closing member is preferably in the form of a plate on one end of a leaf spring. The closing plate is normally spaced a predetermined distance from the outlet opening in the air escape nozzle and the tension in the strand determines the distance or gap between the closing plate and the outlet opening in the nozzle so that the amount of air pressure in the pressure system varies in accordance with the variation in tension in the strand. An air reservoir is provided in the pneumatic pressure system to reduce the susceptibility of the system to react to momentary variations in tension in the strand.

In certain instances, as when winding several synthetic filament yarns onto yarn take-up packages supported on a single winding spindle, such as is customary in a spinning plant, it becomes necessary to control the speed of the winding spindle to control the tension in the yarns being wound onto the corresponding take-up packages. In this instance, the pneumatic sensor of the present invention includes an air escape nozzle and a corresponding closing member positioned adjacent each of the running yarns for determining and measuring the tension of each of the yarns. The individual yarn sensors are operatively connected to the pneumatic pressure system so that a mean or average value of the yarn tension of all of the yarns is determined. This mean tension value is then utilized to control the speed of the take-up winding spindle and thereby maintain the tension in the yarns within a predetermined range.

The pneumatic sensor of the present invention is illustrated in one embodiment as being used for regulating the tension of strands, such as yarn or wire, being unwound from a let-off supply beam of the type used, for example, in the production of thin, steel cables, usually referred to as "steel cord." In order to provide uniformity of tension in the wire being unwound from the let-off beam, it is necessary to keep the tension as uniform and constant as possible. For this purpose, it is known to provide the wire supply beam with a brake device normally operated by guiding the running wire over a roll on a tension lever arm which is mechanically connected to the brake device to thereby provide variations in the tension of the wire being unwound from the supply beam. However, the differences in diameter of the full and empty wire supply beam are considerable and it is difficult to properly control a mechanical connection between the compensating arm and the brake which is sufficient to maintain a constant wire tension.

The pneumatic sensor of the present invention is particularly adapted to maintain the proper tension in running wire in this type of winding installation in which the tension is controlled by a brake device on the wire supply beam. In this instance, the gap between the outlet of the air escape nozzle and the closing member of the pneumatic sensor is varied by movement of the tension lever arm. The pressure variations in the pneumatic system, caused by the variations in the tension in the running wire, control the operation of a pneumatic cylinder for varying the braking force applied to the wire supply beam so that the tension in the running wire is maintained within a predetermined range.

Other objects and advantages will appear as the description proceeds when taken in connection with the accompanying drawings, in which FIG. 1 is a somewhat schematic elevational view of one embodiment of the pneumatic sensor of the present invention and illustrating the holder for the air escape nozzle in cross section;

Figure 4:
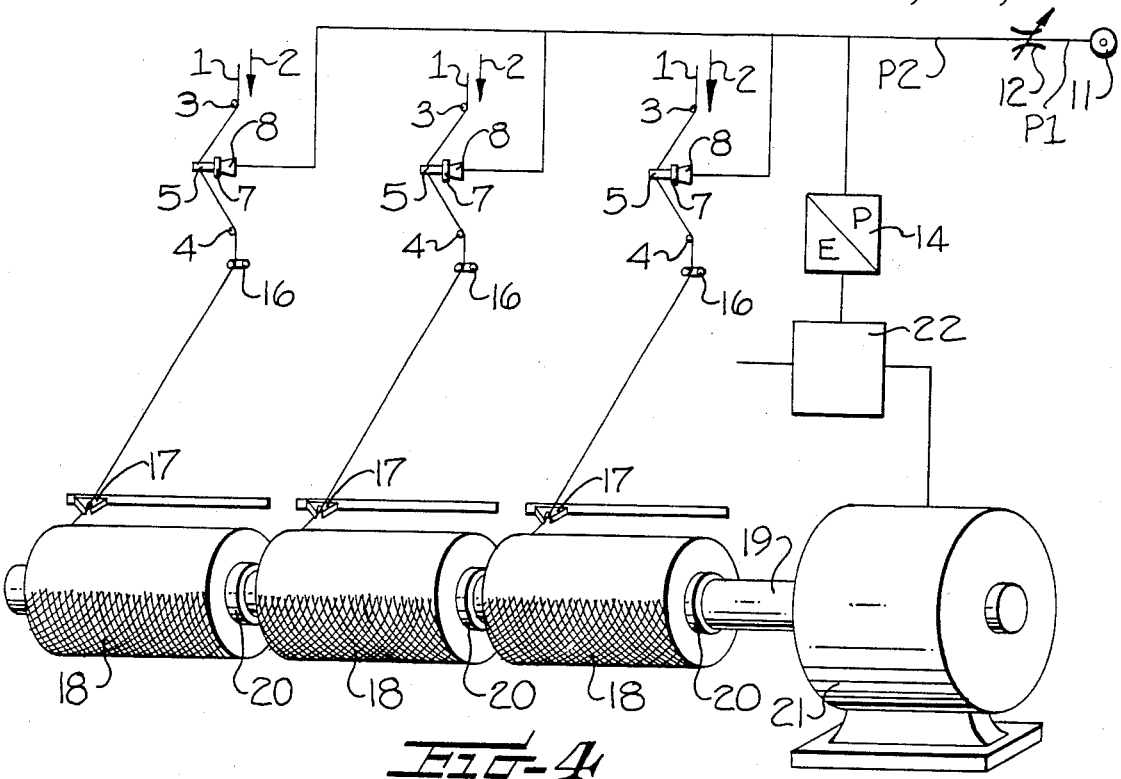
Figure 5:
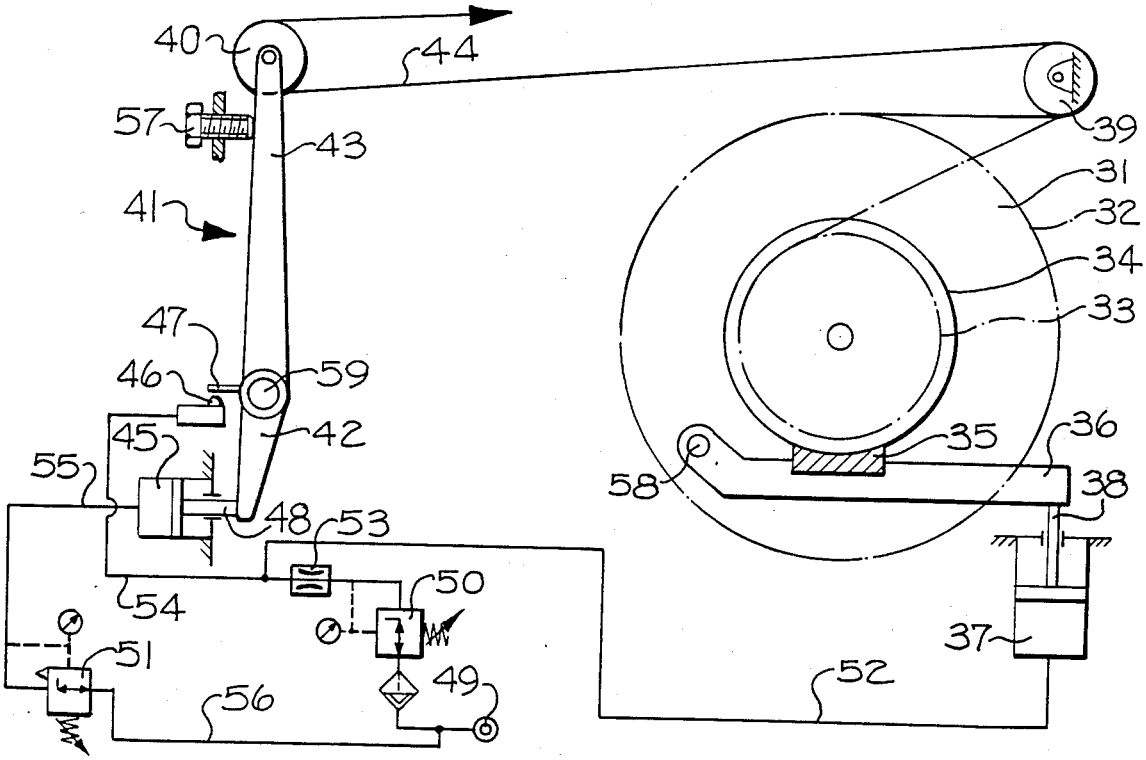

FIG. 4 schematically illustrates an embodiment of the present pneumatic sensor being utilized in detecting the tension in a plurality of yarns being wound onto take-up packages on a common winding spindle; and FIG. 5 schematically illustrates an embodiment of the present pneumatic sensor being utilized to regulate the tension of wire being unwound from a supply beam.

Figure 1:
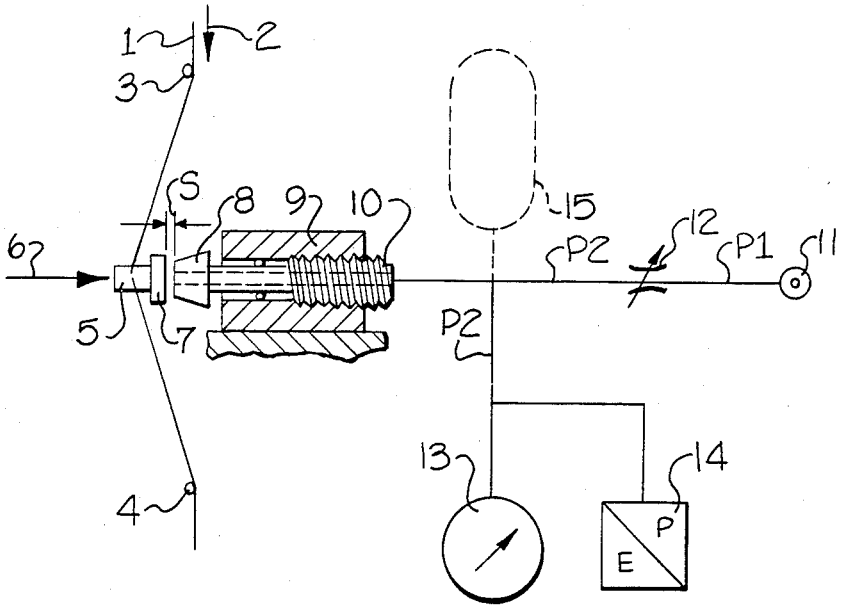
Figure 2:
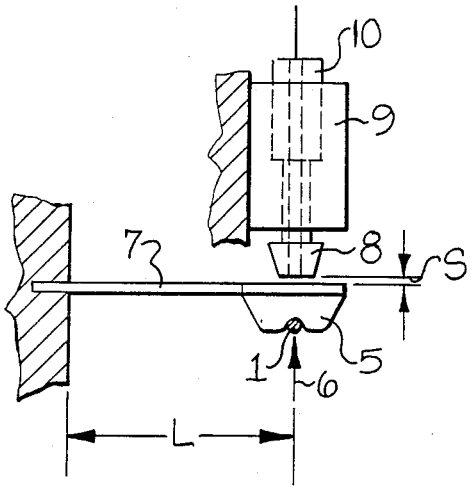
FIG. 2 is a fragmentary plan view of the air escape nozzle and the closing member supported adjacent the outlet opening of the nozzle and with the tension of running yarn controlling the position of the closing member.
Figure 3:
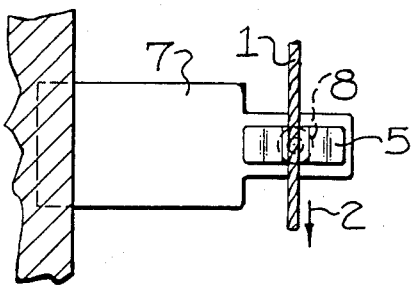
FIG. 3 is a fragmentary elevational view looking at the bottom of FIG. 2.

In the embodiment of FIGS. 1–3, a running yarn 1 is shown as it is being advanced in the direction indicated by the arrow 2. The yarn 1 is deflected from its normal straight path of travel between fixed yarn guides 3, 4 by a yarn guide 5 which forms a part of the pneumatic sensor of the present invention. The tension in the running yarn 1 thereby exerts an inward force, in the direction of arrow 6, on the yarn guide 5. This inwardly directed force 6 varies in accordance with the amount of tension in the yarn 1 and is transmitted to the outer free end of a leaf spring 7, on which the yarn guide 5 is fixed. The inner end of the leaf spring 7 is supported in a fixed or adjustable position on a fixed portion of the winding machine frame, as illustrated in the left-hand portion of FIGS. 2 and 3.

An air escape nozzle 8 is provided with an outlet opening at the free end which is positioned in a spaced predetermined distance, as indicated by the gap S, from the closing member formed by the inner face of the outer free end portion of the leaf spring 7. The air escape nozzle 8 is supported in a fixed housing 9 for axial adjustment toward and away from the leaf spring 7. The outer end of the nozzle 8 is provided with a threaded portion 10 which mates with internal threads in the housing 9 and may be rotated to move the outlet opening of the nozzle 8 inwardly or outwardly relative to the leaf spring closing member 7 for varying the width of the gap S between these two elements and thereby calibrating the yarn sensor. As will be recognized, the width of the yarn gap S also varies with the amount of tension in the yarn 1 as the yarn passes through the yarn guide 5 carried by the leaf spring closing member 7.

The air escape nozzle 8 is connected to a pneumatic pressure system schematically illustrated in the right-hand portion of FIG. 1. The pneumatic pressure system includes a source of compressed air, indicated at 11, for continuously supplying air under a predetermined constant pressure. Suitable air supply lines connect the source of compressed air 11 with the air escape nozzle 8 by means of a throttle valve 12. The air flow resistance of throttle valve 12 is preferably in the form of an adjustable valve for calibration of the yarn sensor. The constant air pressure, indicated at P-1, and supplied by the source 11 drops at the throttle valve 12 to a variable air pressure, indicated at P-2. The pressure drop depends on the air flow through throttle valve 12, which in turn corresponds to the flow through nozzle 8, which in turn depends upon the width of the gap S between the outlet opening of the nozzle 8 and the closing member 7. Thus, the outflowing air and the amount of back pressure of the variable air pressure P-2 depends on the width of the gap S, and the amount of force 6 applied by the tension in the yarn 1. The variable back pressure P-2 also depends upon the adjustment of the air pressure P-1 by the throttle valve 12, by the selection of the type of material of which the leaf spring 7 is formed and the length of the leaf spring 7, as indicated by the dimension L in FIG. 2. After the proper adjustments and calibrations have been made, the variable air pressure P-2 varies in linear relationship and over a wide range with variations in the yarn tension.

The pressure P-2 is directly indicated on a pressure indicating means in the form of a pressure gauge 13 which may be calibrated to indicate the grams of tension on the running yarn 1. In addition, and as an alternative, a pneumatic pressure/electric transducer 14 is illustrated as being connected to the variable pressure P-2. The pressure/electric transducer 14 may be used for emitting yarn tension signals, these signals may be stored or processed by a data processor, or the pressure/electric transducer 14 may be utilized to control a regulating system for varying the take-up speed of a common take-up spindle for a plurality of take-up packages, as illustrated in FIG. 4, or for controlling the rotational let-off speed of a yarn supply beam for controlling the tension in wire being unwound, as illustrated in FIG. 5.

In order to prevent momentary variations or oscillations of the yarn tension from affecting the present yarn sensor, it is preferred that the air pressure system be provided with an air supply reservoir, indicated in dotted lines at 15 in FIG. 1, to equalize undesired fluctuations in the system. It has also been found that these undesired fluctuations can be avoided by changing the shape and type of material of which the leaf spring closing member 7 is formed. As illustrated in FIG. 3, the leaf spring closing member 7 is provided with a narrow outer free end to aid in avoiding an unstable pressure cushion in the gap S, which may lead to undesirable oscillations. Alternatively, the leaf spring member 7 may be provided with perforations, not shown, in the area in alignment with the outlet of the nozzle 8 so as to avoid a pressure buildup in the gap S.

The present pneumatic sensor is illustrated schematically illustrated in FIG. 4 as being associated with a take-up winding system for manmade fibers. A common wind-up spindle 19 is rotated by a variable speed motor 21 so that three yarns 1 are wound onto respective take-up packages 18 on corresponding winding tubes 20, supported on the winding spindle 19. The yarns 1 are advanced in the direction of arrow 2 and directed over fixed yarn guides 3 and 4. The yarns 1 are deflected in their path of travel by the yarn guide 5 which is supported on the leaf spring 7. Each yarn 1 then passes through a fixed yarn guide 16, forming the apex of a reciprocating yarn path formed by a traversing yarn guide 17 to wind the yarn onto the corresponding take-up package 18.

The tension in each of the yarns 1, deflected by the yarn guide 5, is sensed or detected by each of the nozzles 8 and any variation in the space or gap between the nozzle 8 and the closing member 7. Each of the nozzles 8 is connected to the common variable pressure system P-2. The variable pressure system P-2 is connected, by a throttle valve 12, to a constant air pressure P-1 supplied by the source of compressed air 11. The amount of variable pressure in the system P-2 depends upon the total amount of the air escaping from the nozzles 8 at a given time. It may also be said that the pressure in the system P-2 depends upon the mean or average of the amount escaping from all of the nozzles 8. This variable pressure P-2 is transmitted to a pressure/electric transducer 14 and to a control system 22 which controls the rotational speed of the variable electric motor 21. The speed of the variable speed electric motor 21 is controlled in such a manner that the winding speed of the yarn 1, as well as the mean or average value of the yarn tensions in each of the yarns remains substantially constant even at an increasing package diameter.

To describe the control means for varying the speed of the motor 21 in more detail, it will be understood that the tension in each of the yarns 1 depends upon the winding speed, and that the winding speed in turn is the geometrical sum of the peripheral speed of the respective package 18 and the traverse speed of the traversing yarn guide 17. Although the rotational speed (rotations per minute) is identical for each of the packages, the winding speed for one of the packages may be different, for example, the speed of a package may decrease due to a decrease in the yarn denier of the yarn being wound thereupon. Thus if the winding speed of a package should decrease due to a decrease in the yarn denier, the tension of such yarn will also decrease. Thereby, the respective nozzle 8 will be opened in an amount corresponding to the decrease in yarn tension, and this opening leads to an increase in the amount of air escaping through this nozzle. The increased escape of air in turn leads to a decrease in the pressure in the system P-2, and the pressure in the system P-2 is transmitted to the pneumatic/electric transducer 14, and the electrical output signal thereof is transmitted to the control system 22. Upon the yarn tension of one of the yarns decreasing, the pressure responsive to this decrease in tension is transformed in the transducer and applied to the electric motor 21 via the control system 22, in such a way that the rotational speed of the spindle 19 is slightly increased. If for example the yarn tension in one of the yarns decreases, whereas the yarn tension in another yarn is increased, the higher pressure escape at the one nozzle may be balanced by a reduced escape at the other nozzle, and in such case there would be no alteration of the pressure in the system P-2. Thus it is apparent that the pressure in the system P-2 represents the mean value of the tensions of the yarns being wound onto the bobbin tubes, and that the motor 21 operates to vary the speed of operation in accordance with such mean value.

The embodiment of the pneumatic sensor of the present invention illustrated in FIG. 5 is being used to regulate the tension of one or more wires being unwound from a wire let-off spool or beam 31. The dash-dot circles 32 and 33 illustrate the respective maximum and minimum diameters of the wire supply beam 31 as the wire is being withdrawn therefrom. The wire is withdrawn over a stationary deflecting roll 39 and around a guide roll 40 which is rotatably supported on the upper end of a compensating tension lever, broadly indicated at 41, and forming a wire loop 44. A brake shoe 35 is supported in engagement with a brake drum 34 fixed on the wire supply beam 31. The brake shoe 35 is fixed on the medial portion of a brake lever 36 which is pivotally supported at one end as at 58 and its opposite end is operatively connected to an operating piston rod 38 of a pneumatic cylinder 37.

As illustrated in the left-hand portion of FIG. 5, the compensating tension lever 41 is pivotally supported as at 59 and is provided with an upper arm 43 supporting the guide roll 40 and a lower arm 42 which is engaged by an operating piston rod 48 of a pneumatic cylinder 45. The force directed against the lower end of the lever arm 41 by the pneumatic cylinder 45 is opposed to the forced directed against the upper portion of the tension lever arm 41 by the wire engaging the guide roll 40.

The pneumatic cylinder 45 is supplied pressurized air through supply lines 55 and 56 from a source of compressed air 49. The amount of compressed air supplied to the pneumatic cylinder 45 may be adjusted by means of an adjustment valve 51 so that the amount of force applied to the lower end of the lever arm 41 is adjustable. The movement of the compensating lever arm 41 in a counterclockwise direction, caused by the air cylinder 45 may be limited by an adjustable stop 57.

A closing member 47 is fixed at one end on the lever arm 41 and adjacent the pivotal location thereof and the outer end portion overlies the outlet opening in an air escape nozzle 46. The air escape nozzle 46 is connected to the source of compressed air 49 by means of a supply line 54 which is provided with a throttle valve 53. The supply line 54 may also be provided with a suitable pressure gauge and adjustable valve 50.

As the wire is withdrawn from the supply or beam 31, the upper end of the compensating lever arm 41 is moved, in accordance with the tension in the wire passing around the guide roll 40, so that the spacing or gap between the outlet opening in the nozzle 46 and the closing member 47 varies. This variation in the gap causing a corresponding variation of air pressure in the variable pressure supply line 54 and in the supply line 52 which is connected to the operating cylinder 37 to thereby control the position of the brake shoe 35 and change the braking action in accordance with the tension in the wire. Thus, the pneumatic sensor maintains a substantially constant tension in the wire being withdrawn from the supply beam 31.

An increase in the tension in the wire causes the upper end of the lever arm 41 to move in a clockwise direction, thereby increasing the space or gap between the closure member 47 and the outlet opening in the nozzle 46 so that a greater amount of air can escape. This reduces the amount of air pressure in the supply lines 54 and 52 so that the piston rod 38 of the cylinder 37 is lowered and the braking action of the brake shoe 35 against the brake drum 34 is decreased, thereby permitting the supply beam 31 to rotate at a greater let-off speed so that the tension of the wire is reduced to the desired tension, within the predetermined operating range. On the other hand, a decrease in the tension of the wire below the desired tension range causes the upper end of the lever arm 41 to move in a counterclockwise direction and the braking action of the brake shoe 35 against the brake drum 34 is increased to retard the let-off speed. In this case, the tension of the wire is increased to the desired tension, within the predetermined operating range.

In the drawings and specification there has been set forth the best mode presently contemplated for the practice of the various embodiments of the invention, and although specific terms are employed, they are used in a generic and descriptive sense only and not for purposes of limitation, the scope of the invention being defined in the claims.

That which is claimed is:

1. A yarn winding apparatus for winding a plurality of running yarns onto respective take-up packages, and comprising spindle means adapted for rotatably mounting a plurality of bobbin tubes, a variable speed motor for operatively rotating said spindle means, means for guiding a plurality of running yarns onto respective ones of the bobbin tubes to form wound take-up packages thereon, and control means for varying the speed of operation of said variable speed motor in accordance with the mean value of the tensions of the yarns being wound onto said bobbin tubes, to thereby maintain the tensions of the running yarns within predetermined limits, said control means comprising a source of pressurized air, air supply line means connected to said source of compressed air, nozzle means associated with each of said running yarns and operatively connected to said air supply line means for detecting the tension in the running yarn and varying the pressure in said air supply line means in accordance with such tension.

2. A yarn winding apparatus as defned in claim 1 wherein said control means further comprises transducer means for converting the instantaneous pressure in said air supply line means to an electrical signal, and means operatively connecting said electrical signal to said variable speed motor to vary the speed thereof in accordance with the magnitude of the electrical signal.

3. A yarn winding apparatus as defined in claim 2 wherein each of said nozzle means comprises an air outlet opening, closing means supported adjacent said outlet opening and normally supported a predetermined distance from said outlet opening for partially restricting the air exiting therefrom, and yarn guide means for directing the running yarn in a path of travel so that the tension in the running yarn determine the distance between said closing means and said outlet opening.

4. The yarn winding apparatus as defined in claim 3 wherein said closing means of each of said nozzle means comprises a leaf spring member having a free end normally positioned in said spaced relation from said outlet opening.

5. The yarn winding apparatus as defined in claim 4 wherein said yarn guide means of each of said nozzle means includes a yarn guide mounted at the free end of said leaf spring, and such that said yarn guide is adapted to be engaged by the running yarn and a variation in tension of the running yarn imparts movement to said free end and thereby varies the spacing between said closing member and said outlet opening.

6. The yarn winding apparatus as defined in claim 5 wherein each of said nozzle means includes a fixed housing, an air escape nozzle containing said air outlet opening, and means adjustment of the distance said air outlet opening and said closing means.

7. The yarn winding apparatus as defined in claim 1 further comprising air reservoir means communicatively connected with said air supply line means for dampening momentary variations in tension in the running yarn.

8. The yarn winding apparatus as defined in claim 1 further comprising variable throttle valve means disposed in said air supply line means.

9. The yarn winding apparatus as defined in claim 1 further comprising pressure indicating means disposed in said air supply line means.

* * * * *